United States Patent [19]

Bertrand

[11] Patent Number: 4,832,412

[45] Date of Patent: May 23, 1989

[54] MACHINE FOR CUTTING PAVEMENT

[76] Inventor: René Bertrand, 720 St-Jacques, St-Jean-sur-Richelieu (Quebec), Canada, J3B 2M7

[21] Appl. No.: 118,653

[22] Filed: Nov. 9, 1987

[51] Int. Cl.[4] ..... E01C 23/09

[52] U.S. Cl. ..... 299/39; 30/379; 83/928; 125/14; 299/75

[58] Field of Search ..... 299/39, 41, 72, 73, 299/75, 15; 83/498, 489, 928; 125/14; 30/379.5, 379; 404/90

[56] References Cited

U.S. PATENT DOCUMENTS

| | | | |
|---|---|---|---|
| 3,360,298 | 12/1967 | Stoljarov et al. | 299/41 |
| 3,649,071 | 3/1972 | Graff | 299/15 X |
| 3,779,607 | 12/1973 | Staab | 299/39 |
| 4,134,459 | 1/1979 | Hotchen | 173/32 |
| 4,433,871 | 2/1984 | Bertrand | 299/41 |

FOREIGN PATENT DOCUMENTS

| | | | |
|---|---|---|---|
| 1138414 | 10/1962 | Fed. Rep. of Germany | 404/90 |
| 313674 | 12/1971 | U.S.S.R. | 83/928 |

*Primary Examiner*—Stephen J. Novosad
*Assistant Examiner*—David J. Bagnell
*Attorney, Agent, or Firm*—Robic, Robic & Associates

[57] ABSTRACT

There is disclosed a powered truck-like vehicle having a support base at the back and an apparatus for cutting street or road pavement. A length-wise-extensible boom is mounted at one end on the base so that it can extend laterally of the vehicle. An elongated rail structure is mounted on the other end of the boom in a manner such that it can be moved alongside the boom. A saw carrier, mounted on the rail structure so that it can be displaced along it, is provided with a rotary pavement cutting saw that can be displaced relative to the rail structure to cut pavement. The vehicle may further comprise a second lengthwise-extensible boom fixed to the base so as to project laterally from it at right angle to the longitudinal axis of the vehicle. A power jack has a cylinder mounted at the free end of the boom so that it can pivot about an axis parallel to the axis of the vehicle; a second rotary pavement-cutting saw being mounted on the rod of the latter jack cylinder rod for operatively moving the saw toward the pavement to be cut.

25 Claims, 9 Drawing Sheets

MACHINE FOR CUTTING PAVEMENT

BACKGROUND OF THE INVENTION

1. Field of the Invention

The present invention relates to a machine for cutting street or road pavement. The machine is in the form of a powered truck-like vehicle having a support base at the rear on which is provided the apparatus for cutting the pavement.

2. Description of the Prior Art

In my prior Canadian patent No. 1,172,140 of Aug. 7, 1984 (equivalent to U.S. Pat. No. 4,433,871 of Feb. 28, 1984) and my pending Canadian application No. 543,380 of July 30, 1987 (equivalent to U.S. Pat. No. 4,792,190) there are disclosed two different machines adapted to produce a step through a curbstone or a drive-in ramp through a sidewalk suitable to allow vehicles, particularly automobiles, to have a smooth access to a drive leading to a house or other building. In the above-mentioned patents, the saw is made to cut through concrete only horizontally or at a slight fixed angle from the horizontal. In the applications, the saw is made to operate in the same manner but in a more appropriate and efficient way wherein the saw and its carrier can be swung into position by oscillating in a vertical plane so that the angle with respect to the horizontal can be varied. But in both cases, the cutting apparatus is complex and cannot be used for cutting pavement across a street or road, that is in the direction of the apparatus-holding vehicle that stands lengthwise of the street or road. In this sense, the apparatus of the prior patents and applications are not adapted to provide cuts, both across and lengthwise of a street or road pavement.

SUMMARY OF THE INVENTION

According to the present invention, the machine has an apparatus which is adapted to produce both crosswise and lengthwise cuts through the pavement of a street or road so as to open it to effect repair work, install piping or carry out similar public works; which operations cannot be fully done by the more complex machines of the prior art referred to above.

More specifically, the present invention lies in the provision of a machine including a truck-like vehicle having a support base and an apparatus mounted on the base for cutting pavement, the apparatus comprising: a lengthwise-extensible boom and means mounting one end of the boom on the base for the boom to extend laterally thereof; an elongated rail structure and means mounting the rail structure on the other end of the boom for placing the rail structure alongside the boom; a saw carrier and means mounting the saw carrier on the rail structure for displacement therealong; a rotary pavement-cutting saw and means mounting the saw on the carrier for operative displacement of the saw, relative to the rail structure, for cutting pavement, and means, on the saw carrier, for preventing wobbling of the saw relative to the carrier when the saw rotates.

The means that mount the rail structure on the boom are preferably of the type comprising: a connecting arm secured, at one end, to the rail structure at essentially the longitudinal center thereof and extending perpendicularly thereto; means mounting the other end of the connecting arm to the other end of the boom for oscillation of the arm and of the rail structure secured thereto; linkage means joining the beam and the connecting arm, and a power jack having one end mounted on the boom and the other end mounted on the linkage means, constructed to allow the oscillation of the rail structure upon actuation of the jack.

The vehicle according to the invention may also advantageously include a second lengthwise-extensible boom fixed to the base to extend laterally therefrom at right angle to the vehicle longitudinal axis; a power jack having a cylinder and a coaxial cylinder rod displaceable in the cylinder along the longitudinal axis thereof; means mounting the cylinder at the free end of the extensible boom for pivotal movement of the jack about an axis parallel to the vehicle longitudinal axis, and power means for pivoting the jack; a rotary pavement-cutting saw and means mounting the saw on the cylinder rod for operatively moving the saw along a direction parallel to the longitudinal axis of the cylinder and into pavement cutting, and means preventing wobbling of the saw and saw-mounting means about the longitudinal axis of the jack when the saw rotates.

A description of an embodiment of the invention now follows having reference to the appended drawings

BRIEF DESCRIPTION OF THE DRAWINGS

FIG. 6 is an elevation view of the cutting apparatus taken in the direction of arrow VI in FIG. 4;

FIG. 11 is a diagrammatic rear view of the apparatus of FIG. 10 for sawing a lengthwise cut and FIG. 12 is a perspective view while

DESCRIPTION OF THE PREFERRED EMBODIMENT

General Description

Figure 1:
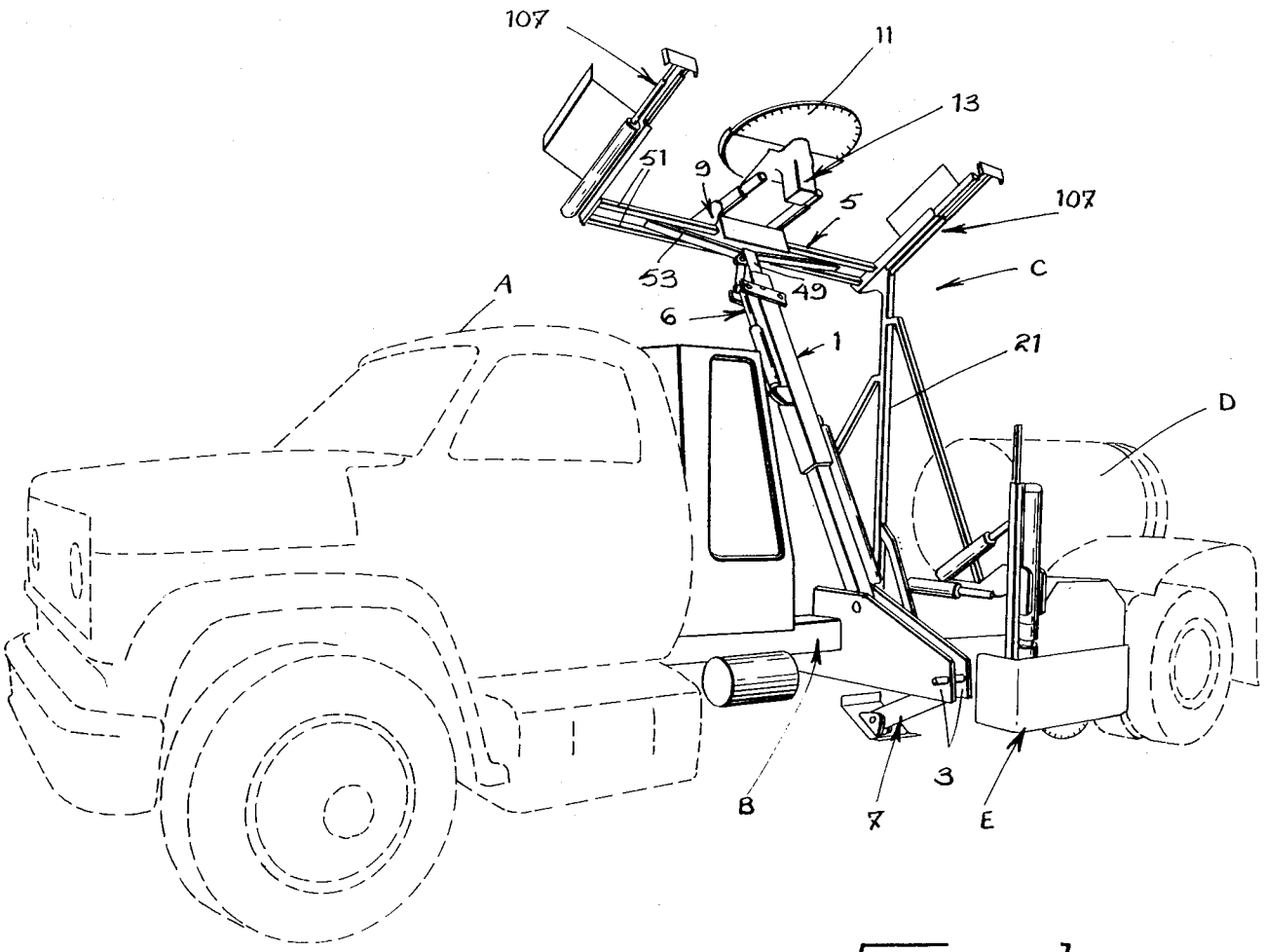
FIG. 1 is a perspective view of a machine built according to the teaching of the present invention.
Figure 2:
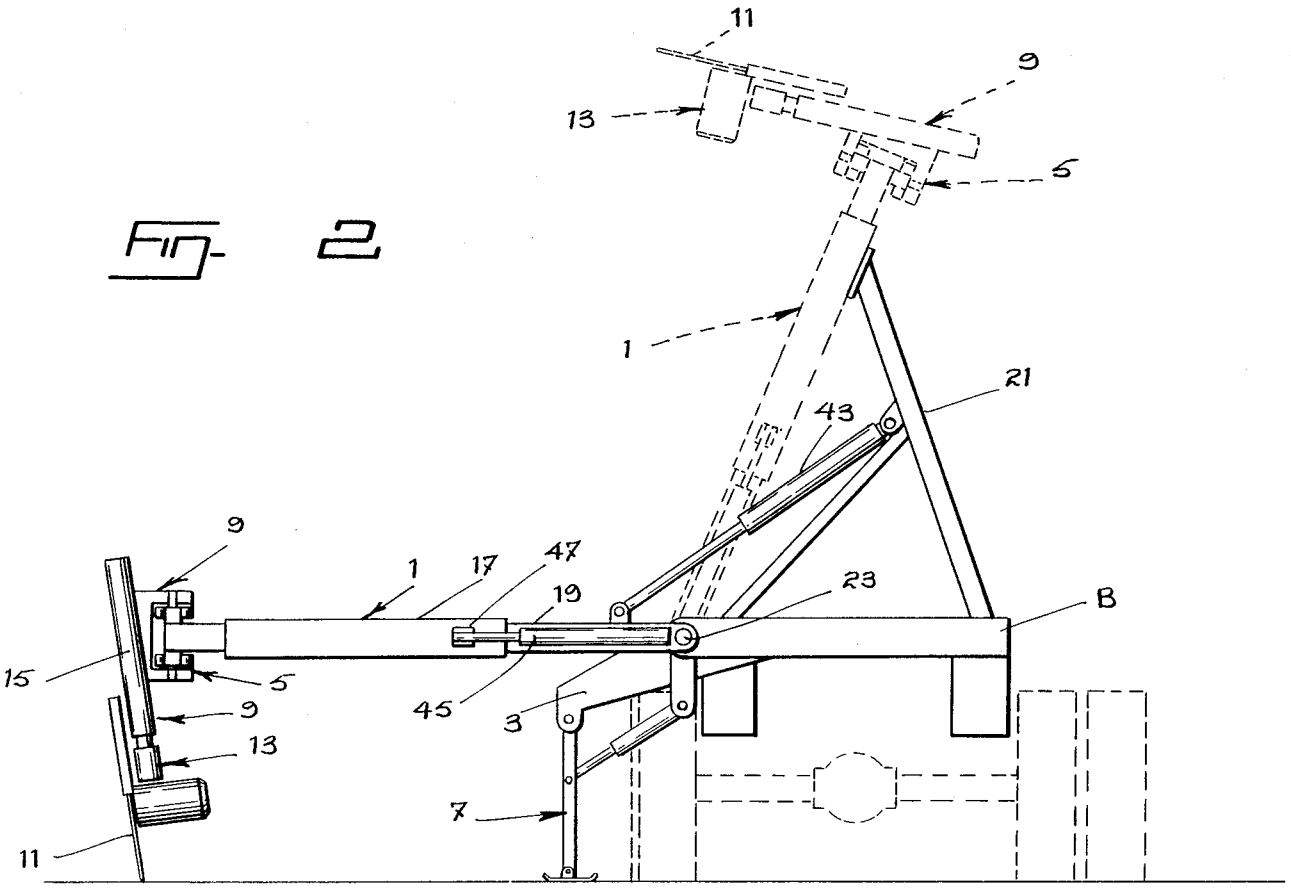
FIG. 2 is a diagrammatic rear elevation view.

In order to appreciate the various features of the invention better, a general description of the machine will be given, followed by a detailed one.

Referring to FIGS. 1 to 9, the machine includes a motor truck having a cab A and a rear base B on which the apparatus C, for producing crosswise and short lengthwise cuts or grooves, is mounted as well as a fluid pressure reservoir D. The pressure fluid may either be air or oil depending on whether or not pneumatic or hydraulic power jacks and motors are used to actuate the various components of the apparatus.

The latter includes a lengthwise-extensible boom 1 mounted at one end on a pair of spaced brackets 3 of the base for pivotal movement of the boom 1 about an axis parallel to the longitudinal axis of the vehicle so that it may be made to extend laterally, at right angle to the vehicle longitudinal axis. The other end holds an elongated rail structure 5 which can be swung laterally by means of a linkage assembly 6 (FIG. 3), and be brought parallel to the boom 1 along either one of its sides. A conventional retractable leg 7 is pivoted to the same brackets 3 to stabilize the vehicle during operation of the apparatus C. A saw carrier 9 is mounted and powered so as to move along the rail structure 5. A rotary pavement-cutting saw 11 is mounted on the carrier 9 so that it can be displaced in an upright direction by means of a pair of parallel power jacks 15, of the carrier 9; the jacks 15 also serving to prevent the saw 11 from wobbling or swaying with respect to the carrier. Similarly, the boom 1 is formed of two telescoping non rotatable members 17, 19, square in cross-section for instance, to prevent swaying of the rail structure 5 and saw carrier 9 about the boom axis.

In operation, the boom 1 and the rail structure 5 are pivoted at 23 (FIG. 2) as an assembly, from an inoperative position above the base B where it rests against an upright support 21, to an intermediate position (FIG. 3) where the assembly is swung outwardly of the base B with the saw 11 being almost vertical and the rail structure 5 being parallel to the vehicle longitudinal axis. In that position, the saw 11 can be lowered by the jacks 15 and a relatively short cut, limited to the length of the rail structure 5, taken through the pavement, lengthwise of the street or road.

However, the apparatus C is more particularly adapted to taking crosswise cuts in which case, with the saw 11 lifted off the ground, the rail structure 5 is swung laterally by rotation about a further pivot 25 at the other end of the boom 1; the axis of pivot 25 being normal to that of the boom. The rotation is obtained by means of the linkage assembly 6 and the rail structure is placed alongside the boom 1, essentially normal to the axis of the vehicle which is taken to be parallel to the axis of the street or road. In this respect and where required, angle adjustment of the rail structure 5 may be obtained by using the linkage assembly 6. In the selected position, the saw 11 is brought down against the pavement by the carrier jacks 15 and the cut run as at 27 in FIG. 4. Should a longer cut be required than is available with the length of the rail structure 5, the saw may be lifted and the extensible boom 1 lengthened or shortened accordingly.

Where cuts 29 (FIG. 10) of indefinite length, along the street or road, are to be taken, a further cutting apparatus E (FIG. 1) illustrated in detail FIGS. 10, 11, 12 and 13, is used. It includes a second lengthwise-extensible non-rotatable boom 31, secured to and across the vehicle chassis 33 (FIG. 11) to extend laterally of the vehicle and at right angle to its longitudinal axis. A power jack 35 has its cylinder 37 mounted for oscillation about an axis parallel to the vehicle longitudinal axis. A saw 39 has a saw mount 41 fixed to the rod 43 of the jack 35. Thus, when the jack 35 is actuated to bring the saw 39 down against the pavement and rotated, a cut lengthwise of the street or road may be obtained by very slowly advancing the vehicle. If necessary, the position of the saw 39 relative to the vehicle may be adjusted by lenghtening or shortening the second boom 31.

Detailed Description

Referring again to FIGS. 1 to 9, the boom 1 is made to move between operative and inoperative positions by a power jack 43 (FIG. 2) of which the cylinder part is pivoted to the upright support 21; the rod part being pivoted to the square boom member 19 which is pivoted to the base B, at 23. The outer boom member 17 can be moved lengthwise relative to the inner boom member 19 by a further jack 45 of which the cylinder part pivots at 23 and the rod part at 47 on the outer boom member 17, as clearly shown in FIG. 2.

Figure 3:
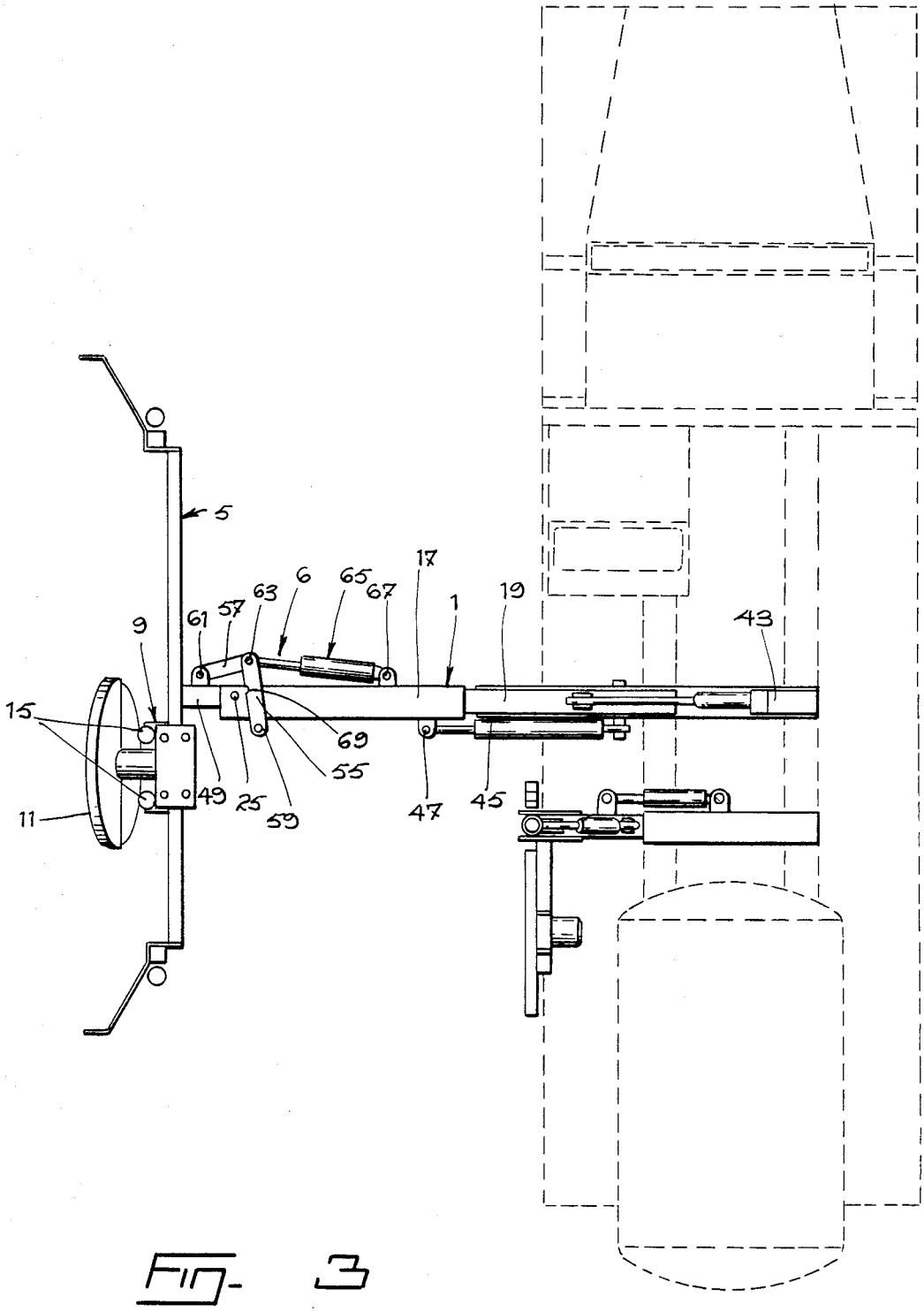
FIG. 3 is a top plan view.
Figure 4:
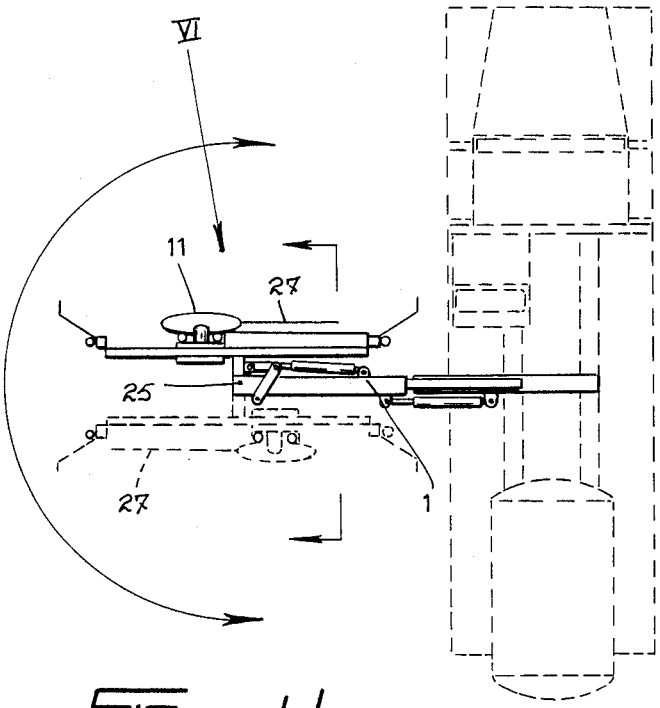
FIG. 4 is also a top plan view showing how the pavement cutting saw can be placed alongside the holding boom for cutting crosswise cuts.

Going now to the other end of the boom 1, particular reference being had to FIG. 3, the means mounting the rail structure 5 (with the saw carrier 9, saw 11 and saw mount 13 thereon) on the boom 1 are provided by the linkage assembly or means 6, aforesaid, constructed as follows.

A square connecting arm 49 has an outer end secured to the longitudinal center of the rail structure 5, perpendicularly to it. In the case where the latter comprises two elongated square tracks 51, as in FIGS. 6 to 9, the square arm 51 is fixed between the tracks. Another possibility is shown in FIG. 1 where a steel blade 53 has its two ends secured to and between the tracks 51, the connecting arm 49 being then fixed to it. The inner end of the arm 49 is mounted on the previously mentioned pivot 25 at the outer end of the boom member 17. The linkage assembly 6, which oscillates the connecting arm 49, has a pair of links 55, 57, of which one end is pivoted, at 59, 61, respectively to the boom member 17 and to the arm 49 while common ends are pivoted together at 63. A further power jack 65 has its rod free end pivoted also at 63 and its cylinder pivoted at 67, on the member 17. It will be appreciated, from FIGS. 3 and 4, that actuation of the jack 65 will bring the rail structure 5 on one side or the other of the boom 1. Counterclockwise rotation may be controlled by a notch 69 on the link 55, butting against the pivot 25. A similar arrangement may be provided to limit clockwise rotation. The abutment arrangements should preferably bring the rail structure 5 parallel to the longitudinal axis of the boom 1, as in FIG. 4.

Figure 7:
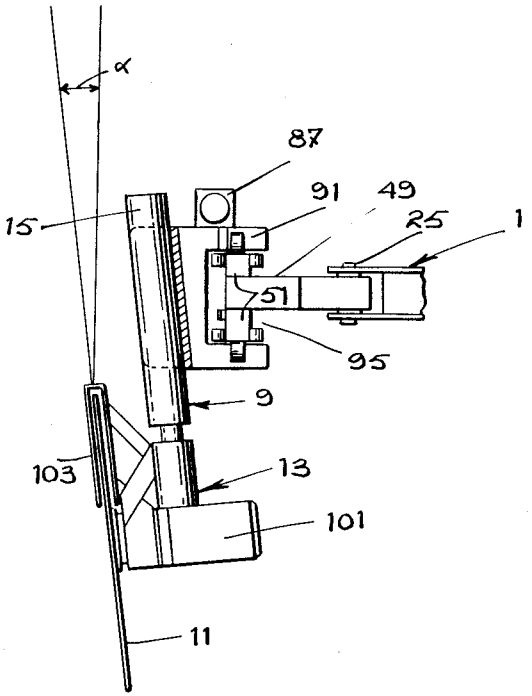
FIGS. 7, 8 and 9 are end views of the apparatus of FIG. 6, drawn to show different features.
Figure 8:
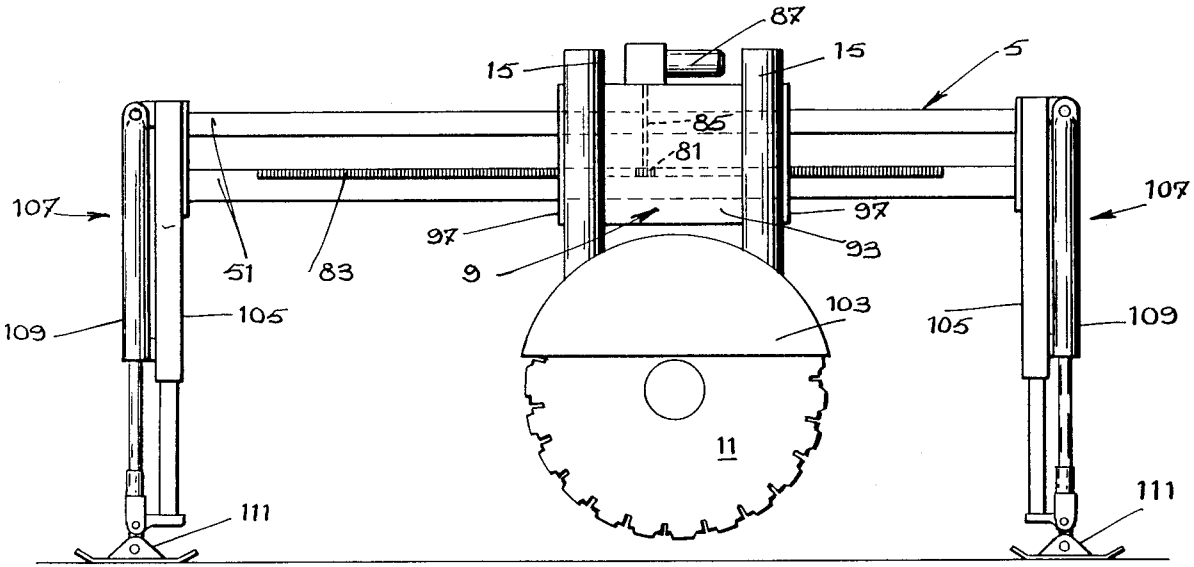
Figure 8:
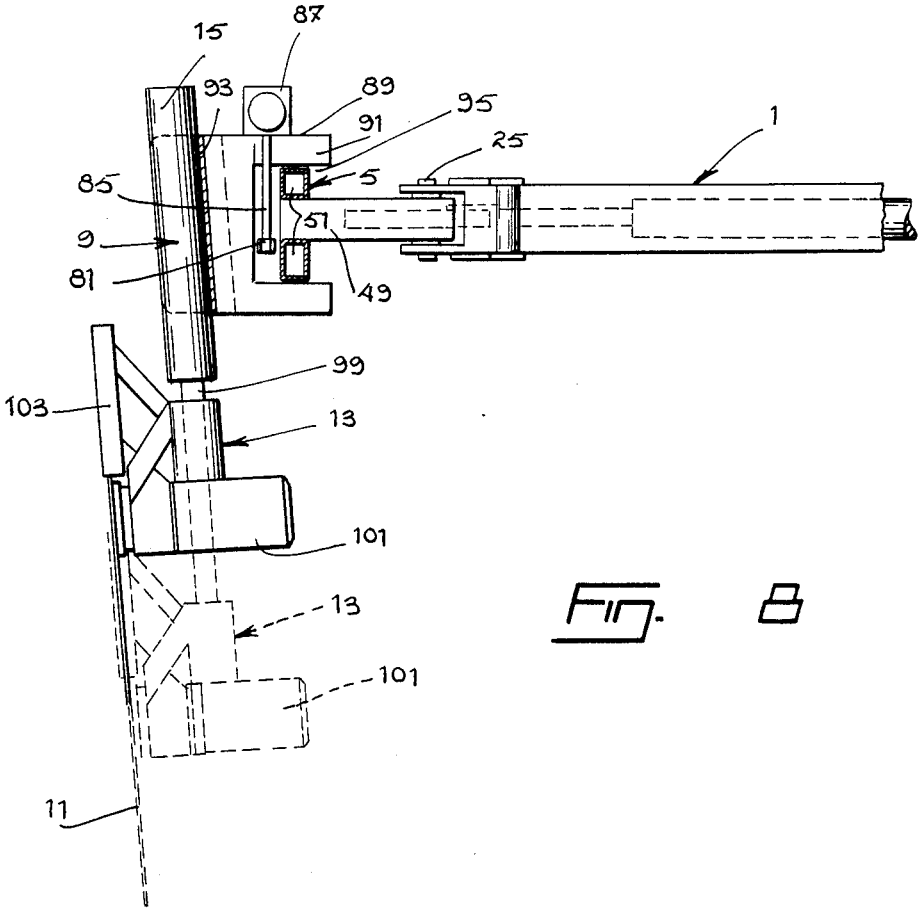
Figure 9:
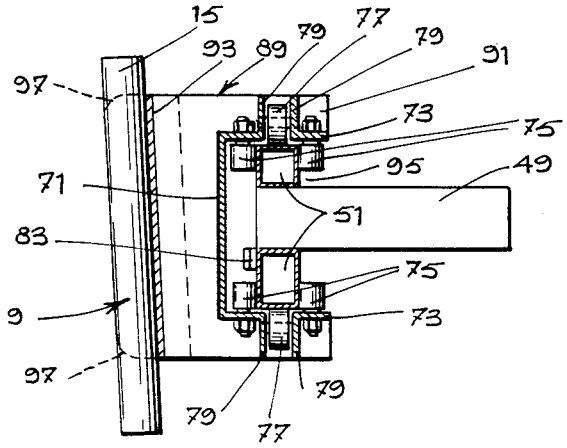
Figure 10:
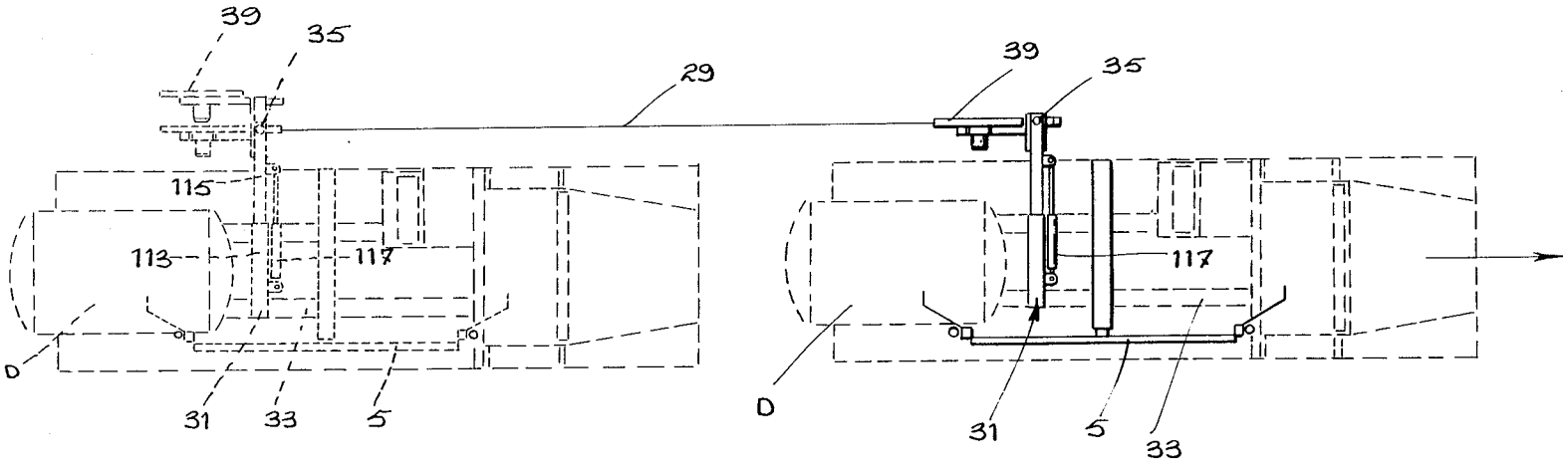
FIG. 10 is a plan view of a vehicle according to the invention, illustrating it in two positions to show the use of an additional apparatus for sawing a cut lengthwise of a road or street, parallel to the vehicle and as the latter travels slowly.

The means mounting the saw carrier 9 on the rail structure 5 are detailed in FIGS. 7, 8 and 9. They comprise a channel-shaped member 71 fixed at its ends to the saw carrier 9. It extends lengthwise of and straddles, by its flanges 73, the two tracks 51. Pairs of vertical rollers 75 are mounted for free rotation on the flanges 73 and ride on opposed lateral faces of the tracks 51 while pairs of horizontal rollers 77 are mounted for free rotation on pairs of ears 79, projecting from the flanges 73, and ride on upper and lower faces of the tracks 51. The described saw carrier mounting means 71 to 79 are displaced along the tracks 51 by a pinion 81 (FIG. 8) meshing with a toothed rack 83 (FIGS. 6 and 9) provided on an outer face of the lower one of the tracks 51; the pinion being fixed at the outer end of a shaft 85 connected to a motor 87 secured to the saw carrier 9.

On the other hand, the saw carrier 9 comprises a U-shaped support 89 to the flanges 91 of which the ends of the channel member 71 are fixed (FIG. 9); the side flanges 91 of the support 89 being interconnected by a central web 93. The flanges 91 are appropriately notched at 95 for avoiding the tracks 51 and thus allowing displacement of the saw carrier mounting means 71 to 79. The saw carrier 9 further has a pair of cheek plates 97 (FIG. 6) fixed to and outwardly of the flanges 91 of the U-shaped support 89, projecting rearwardly of the web 93 to form with it two corner recesses into which the cylinders of the jacks 15 are secured.

Figure 5:
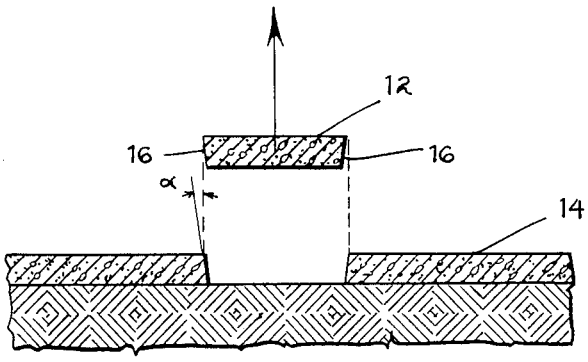
FIG. 5 is a diagrammatic side view of a pavement block being removed.

As mentioned previously, the saw 11 is connected to the carrier 9 by a rigid frame mount 13 which is secured to the rods 99 of the jacks 15 so as to be displaceable in an upright direction with the said rods. A motor 101 is fixed to the frame mount 13 and has a shaft to the end of which the saw is secured. The latter is partially covered by a protector 103. From FIG. 7, it will be seen that the saw 11, which is planar, is slightly inclined by an angle $\alpha$ of about 6°, to the vertical when the boom 1 and connecting arm 49 are horizontal. This may be obtained by appropriately inclining the jacks 15 and the saw frame mount 13. In this manner, blocks 12 of pavement 14 will have slightly inclined edges 16 for easy removal, as shown in FIG. 5. It will also be noted, particularly from FIG. 6, that the two jacks 15, being fastened to both the cheek plates 97 and the web 93, serve to prevent any wobbling of the saw 11 during its rotation.

FIG. 6 also shows that the ends of the two tracks 51 of the rail structure 5 are fixed to the telescopic standards 105, square in cross-section, of known levelling assemblies 107 which also include power jacks 109. The latter press the pivotable shoes 111 against the ground to level the rail structure 5 while the square telescopic standards 105 prevent rotation of the rods of the jacks 109.

Figure 12:
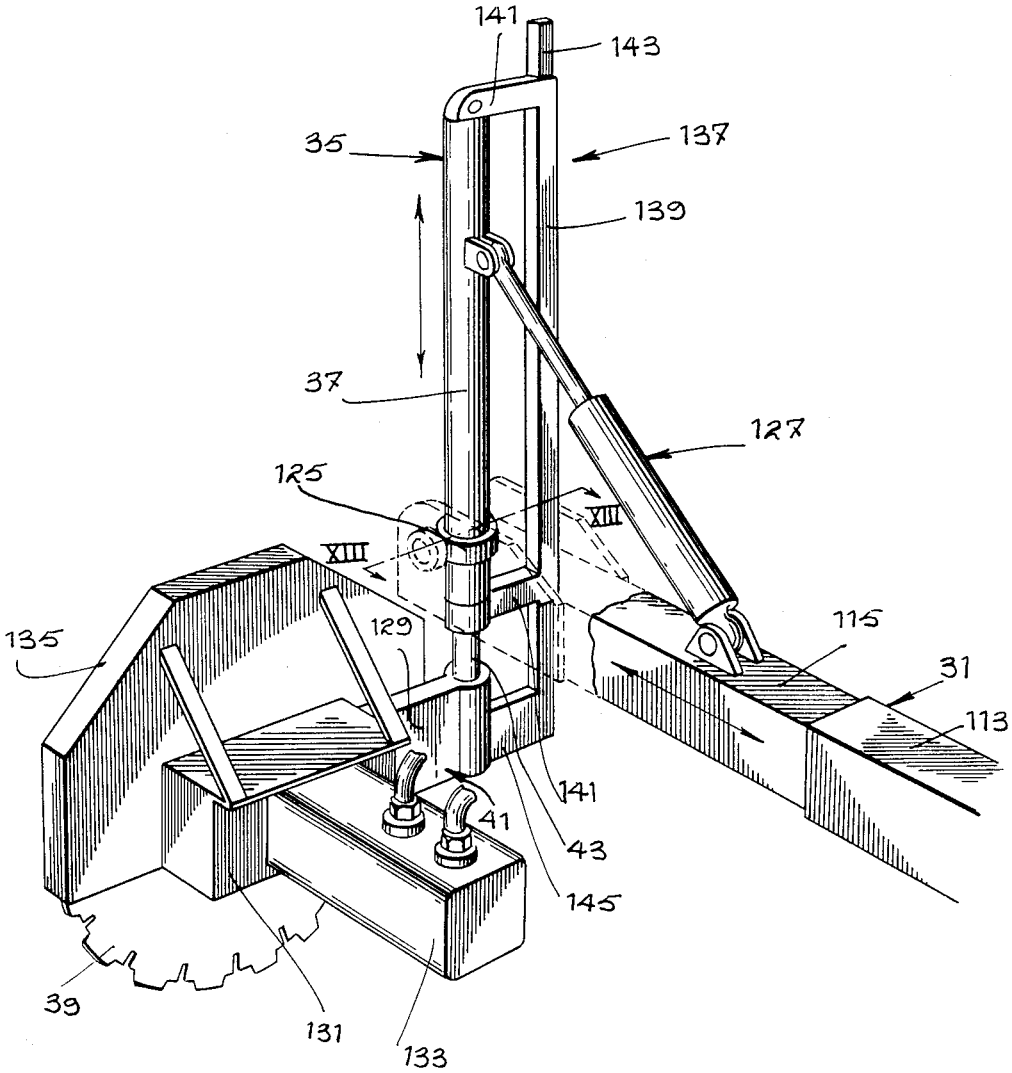
Figure 13:
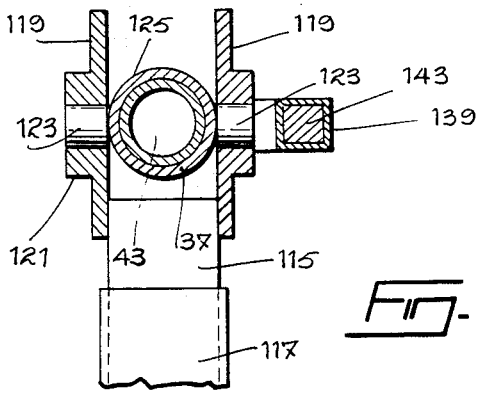
FIG. 13 is a view in a plane along line XIII—XIII of FIG. 12.

Referring back to FIGS. 10 to 13, the second boom 31 has a square outer sleeve 113 into which fits a square inner rod 115 for non-rotation; the rod 113 being moved in and out of the sleeve 115 by a jack 117. A pair of cheek plates 119 are secured to opposite sides of the rod 115 and extend away from its free end, as shown in FIG. 13. Each plate 119 is formed with a bearing 121 having a central bore into which fits a pin 123, for pivotal movement about an axis 124 (FIG. 11) parallel to the longitudinal axis of the vehicle; the pins 123 being solid with and radially projecting from a collar 125 fixed to the cylinder 37 of the jack 35. The aforesaid saw mount 41 is secured to the lower end of the rod 43 of the jack 35. An actuating power jack 127 is pivotally connected respectively to the cylinder 37 of the jack 35 and to the rod 115 of the boom 31. The mount 41 is composed of a connecting arm 129 fixed at one end to the rod 43 and fixed at the other end to a speed reducer 131 of a motor 133; the saw 39 being fixed to the free end of the output shaft (not shown) of the speed reducer 131. A protection cover 135 fits over the upper half of the saw 39, being secured to the housing of the speed reducer 131.

Figure 11:
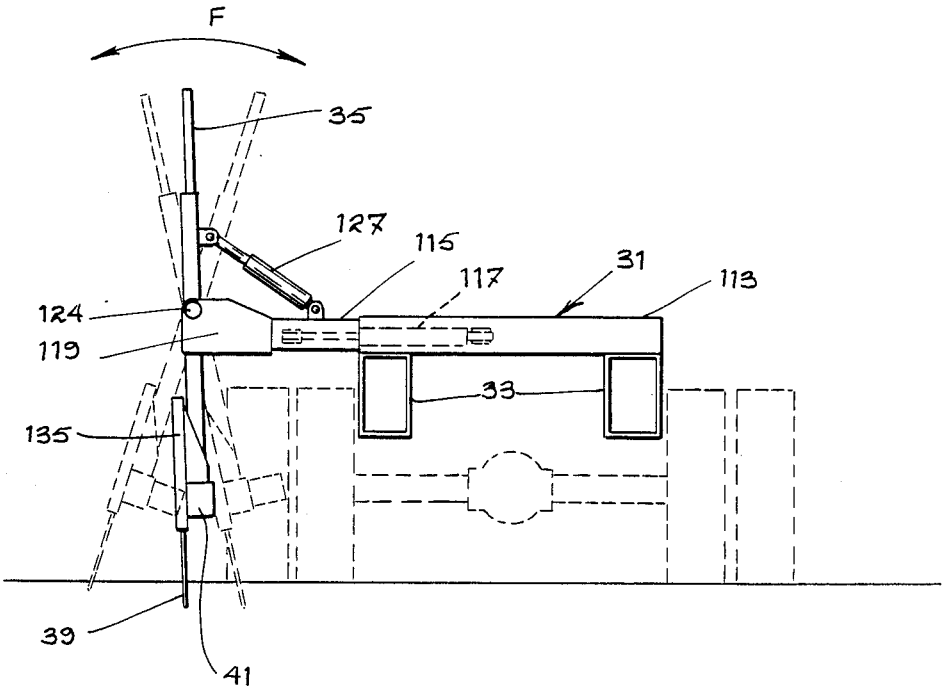

With the above description in mind, .it will be understood that actuation of the jack 127 will allow oscillation of the jack 35, mount 41 and saw 39 as shown by the double arrow F in FIG. 11 so that the planar saw 11 may be placed at an angle of about 96° with the longitudinal axis of the boom 31, or 6° with the vertical as in FIG. 7, to provide the preferably inclined sides 16 to the pavement block 12 (FIG. 5); this is assuming, of course, that the longitudinal axis of the boom 31 is horizontal. Finally, the jack 35 can be actuated to bring the saw 39, through the mount 41, in contact with the pavement to be cut.

As aforesaid, means are provided to prevent wobbling of the saw 39 and of the saw mounting means 41 about the longitudinal axis of the jack 35 when the saw rotates. As shown in FIGS. 12 and 13, such means preferably comprise a U-shaped member 137 having a hollow square web 139 and a pair of flanges 141 of which the ends are secured to the ends of the cylinder 37 of the jack 35; and an L-shaped member having a square vertical arm 143 slidably fitting into the hollow web 139 and a horizontal arm 145 of which the outer end is made solid with the arm 129 of the saw mounting means 41. The latter are thus secured to the jack 35 which cannot rotate about its longitudinal axis because of the rotation pins 123 (FIG. 13) mounted in the bearing 121 fixed to the rod 115 of the boom 31.

I claim:

1. A machine including a truck-like vehicle having a support base and an apparatus mounted on said base for cutting pavement, said apparatus comprising:

a lengthwise-extensible boom and means mounting one end of said boom on said base for said boom to extend laterally thereof;

an elongated rail structure and means mounting said rail structure on the other end of said boom, said mounting means allowing said rail structure to be swung laterally and brought alongside said boom;

a saw carrier and means mounting said saw carrier on said rail structure for displacement therealong;

a rotary pavement-cutting saw and means mounting said saw on said saw carrier for operative displacement of said saw, relative to said rail structure, for cutting pavement, and means, on said saw carrier, for preventing wobbling of said saw relative to said saw carrier when said saw rotates, wherein said saw carrier comprises:

a support fixed to said means mounting said saw carrier on said rail structure for displacement therealong;

a pair of parallel power jacks each having a cylinder and a cylinder rod; and means securing jack cylinders spacedly on said support, transversaly of said rail structure, to constitute said means preventing wobbling of said saw relative to said saw carrier; and wherein said means mounting said rotary saw on said saw carrier comprises:

a frame mount secured to the rods of the parallel power jacks so as to be displaceable with said rods towards or away from said rail structure; and power means fixed to said frame mount for rotating the saw.

2. A machine as claimed in claim 1, wherein said rail structure-mounting means comprise:

a connecting arm secured, at one end, to said rail structure at essentially the longitudinal center thereof and extending perpendicularly thereto;

means mounting the other end of said connecting arm to the other end of said boom for oscillation of said arm and of said rail structure secured thereto;

linkage means joining said boom and said connecting arm, and a power jack having one end mounted on said boom and the other end mounted on said linkage means, constructed to allow said oscillation of said rail structure upon actuation of said jack.

3. A machine as claimed in claim 2, wherein said rail structure comprises a pair of elongated spaced parallel tracks and said connecting arm has said one end thereof secured to said tracks therebetween and at the center thereof.

4. A machine as claimed in claim 1, wherein said extensible boom has two telescoping non-rotatable members, and means moving said members relative to one another to displace said saw laterally with respect to said vehicle.

5. A machine as claimed in claim 1, wherein said vehicle has longitudinal axis and further comprises:

a second lengthwise-extensible boom fixed to said base to extend laterally therefrom at right angle to said vehicle longitudinal axis;

a further power jack having a cylinder and a coaxial cylinder rod displaceable in said cylinder along the longitudinal axis thereof;

means mounting said cylinder at the free end of said second extensible boom for pivotal movement of said further jack about an axis parallel to said vehicle longitudinal axis, and power means for pivoting said jack;

a second rotary pavement-cutting saw and means mounting said second saw on said cylinder rod of said further jack for operatively moving said second saw along a direction parallel to said longitudinal axis of said cylinder and into pavement cutting, and means preventing wobbling of said second saw and saw-mounting means about the longitudinal axis of said further jack when said second saw rotates.

6. A machine as claimed in claim 5, wherein said means preventing wobbling of said second saw comprise:

a U-shaped member having a hollow non-cylindrical web and a pair of flanges secured, at the outer ends thereof, to the ends of said further jack cylinder, and an L-shaped member having one non-cylindrical arm slidably fitting into said hollow non-cylindrical web and another arm having an outer end secured to said second saw-mounting means.

7. A machine as claimed in claim 6, wherein said second extensible boom has two telescoping non rotatable members, and means moving said members relative to one another to displace said saw laterally with respect to said vehicle.

8. A machine as claimed in claim 1, wherein said saw is a planar saw mounted parallel to the longitudinal axes of said parallel cylinders and wherein said cylinders extending a vertical plane which is slightly inclined with respect to the horizontal plane defined by the rail structure and the boom when said boom is laterally extended.

9. A machine as claimed in claim 8, wherein said rail structure comprises a pair of elongated spaced parallel tracks and said saw carrier mounting means comprise:

a channel-shaped member extending lengthwise of and straddling said tracks;

freely rotatable rollers, on said channel-shaped member, riding on said parallel tracks, and power means driving said channel-shaped member and rollers along said tracks.

10. A machine as claimed in claim 9, wherein said means mounting said boom on said base are pivot means allowing said boom and rail structure to be displaced between an inoperative position wherein said rail structure stands above said base and an operative position wherein said boom and rail structure are swung laterally outwardly of said base for cutting pavement.

11. A machine as claimed in claim 9, wherein said extensible boom has two telescoping non-rotatable members, and means moving said members relative to one another to displace said saw laterally with respect to said vehicle.

12. A machine including a truck-like vehicle having a support base and an apparatus mounted on said base for cutting pavement, said apparatus comprising:

a lengthwise-extensible boom having a longitudinal axis and means mounting one end of said boom on said base for said boom to extend laterally thereof;

an elongated rail structure and means mounting said rail structure on the other end of said boom, essentially at the lengthwise center of said rail structure; said means allowing said rail structure to be swung in either direction about an axis normal to said boom longitudinal axis and brought alongside said boom;

a saw carrier and means mounting said saw carrier on said rail structure for displacement therealong;

a rotary pavement cutting saw and means mounting said saw on said saw carrier for operative displacement of said saw, relative to said rail structure, for cutting pavement, and means, on said saw carrier, for preventing wobbling of said saw relative to said carrier when said saw rotates, wherein said saw carrier comprises:

a support fixed to said means mounting said saw carrier on said rail structure for displacement therealong;

a pair of parallel power jacks each having a cylinder and a cylinder rod; and means securing said jack cylinders spacedly on said support, transversaly of said rail structure to constitute said means preventing wobbling of said saw relative to said saw carrier; and wherein said means mounting said rotary saw on said saw carrier comprises:

a frame mount secured to the rods of the parallel power jacks so as to be displaceable with said rods towards or away from said rail structure; and power means fixed to said frame mount for rotating the saw.

13. A machine as claimed in claim 12, wherein said rail structure mounting means comprise:

a connecting arm secured, at one end, to said rail structure at essentially the longitudinal center thereof and extending perpendicularly thereto;

means mounting the other end of said connecting arm to said other end of said boom for oscillation of said arm and of said rail structure secured thereto;

linkage means joining said boom and said connecting arm, and a power jack having one end mounted on said boom and the other end mounted on said linkage means, constructed to allow, upon actuation of said jack, said oscillation of said rail structure.

14. A machine as claimed in claim 13, wherein said linkage means and power jack are selected for moving said rail structure, saw carrier and saw for bringing said saw parallel to said boom longitudinal axis.

15. A machine as claimed in claim 13, wherein said linkage means and power jack are selected for moving said rail structure, saw carrier and saw for bringing said saw parallel to said boom longitudinal axis selectively on either side of said boom.

16. A machine as claimed in claim 13, wherein said extensible boom has two telescoping non-rotatable members, and means moving said members relative to one another to displace said saw laterally with respect to said vehicle.

17. A machine as claimed in claim 13, wherein said structure comprises a pair of elongated spaced parallel tracks and said connecting arm has said one end thereof secured to said tracks therebetween and at the center thereof.

18. A machine as claimed in claim 13, wherein said rail structure comprises a pair of elongated spaced parallel tracks and said saw carrier mounting means comprise:

a channel-shaped member extending lengthwise of and straddling said tracks;

freely rotatable rollers, on said channel-shaped member, riding on said parallel tracks, and power means driving said channel-shaped member and rollers along said tracks.

19. A machine as claimed in claim 18, wherein said connecting arm has said one end thereof secured to said tracks, therebetween and at the center thereof.

20. A machine as claimed in claim 18, wherein the support of said saw carrier is fixed to the ends of said channel-shaped member and extends away from said connecting arm.

21. A machine as claimed in claim 20, wherein said saw is a planar saw mounted parallel to the longitudinal axes of said parallel cylinders and wherein said cylinder axes make an angle of about 96° with respect to the longitudinal axes of said connecting arm and of said boom so as to cause said saw to produce cuts through pavement making an angle of about 6° with the vertical when said boom and connecting arm are horizontal.

22. A machine as claimed in claim 12, wherein said extensible boom has two telescoping non-rotatable members, and means moving said members relative to one another to displace said saw laterally with respect to said vehicle.

23. A machine as claimed in claim 12, wherein said means mounting said boom on said base are pivot means allowing said boom and rail structure to be displaced between an inoperative position wherein said rail structure stands above said base and an operative position wherein said boom and rail structure are swung laterally outwardly of said base for cutting pavement.

24. A machine including a truck-like vehicle having a longitudinal axis, a base on said vehicle, and an apparatus mounted on said base for cutting pavement, said apparatus comprising:

a lengthwise-extensible boom fixed to said base to extend laterally therefrom at right angle to said vehicle longitudinal axis;

a power jack having a cylinder and a coaxial cylinder rod displaceable in said cylinder along the longitudinal axis thereof;

means mounting said cylinder at the free end of said extensible boom pivotal movement of said jack about an axis parallel to said vehicle longitudinal axis, and power means for pivoting said jack;

a rotary pavement-cutting saw and means mounting said saw on said cylinder rod for operatively moving said saw along a direction parallel to said longitudinal axis of said cylinder and into pavement cutting, and means preventing wobbling of said saw and saw-mounting means about the longitudinal axis of said jack when said saw rotates, wherein said wobbling preventing means comprise:

a U-shaped member having a hallow non-cylindrical web and a pair of flanges secured, at the outer ends thereof, to the ends of said jack cylinder, and an L-shaped member having one non-cylindrical arm slidably fitting into said hollow non-cylindrical web and another arm having an outer end secured to said saw-mounting means.

25. A machine as claimed in claim 24, wherein said extensible boom has two telescoping non-rotatable members, and means moving said members relative to one another to displace said saw laterally with respect to said vehicle.

* * * * *